US007857676B2

(12) United States Patent
Ali et al.

(10) Patent No.: US 7,857,676 B2
(45) Date of Patent: Dec. 28, 2010

(54) SWIMMING ROBOT

(76) Inventors: Farrag Abdelkarim Ali, P.O. Box 1014, Hawally (KW) 32011; Mansour A. Alsaed, P.O. Box 1616, Safat (KW) 13017; Mohammed Farrag Abdelkarim Ali, P.O. Box 1014, Hawally (KW) 32011

( * ) Notice: Subject to any disclaimer, the term of this patent is extended or adjusted under 35 U.S.C. 154(b) by 893 days.

(21) Appl. No.: 11/685,891

(22) Filed: Mar. 14, 2007

(65) Prior Publication Data

US 2008/0227363 A1 Sep. 18, 2008

(51) Int. Cl.
*A63H 23/00* (2006.01)
*A63H 23/10* (2006.01)

(52) U.S. Cl. ..... 446/153; 446/158; 472/129

(58) Field of Classification Search ..... 446/153, 446/156, 158, 330, 335, 352–354, 358, 376; 472/128, 129; 441/129, 130; 440/21
See application file for complete search history.

(56) References Cited

U.S. PATENT DOCUMENTS

| | | | | | |
|---|---|---|---|---|---|
| 1,258,963 | A * | 3/1918 | Troje | 446/153 |
| 2,962,283 | A * | 11/1960 | Casey | 472/129 |
| 2,976,835 | A * | 3/1961 | Germick | 440/26 |
| 2,991,076 | A * | 7/1961 | Hale | 472/129 |
| 3,120,833 | A * | 2/1964 | Curelich | 440/27 |
| 3,153,879 | A * | 10/1964 | Lucas | 446/158 |
| 3,247,613 | A * | 4/1966 | Parker | 446/158 |
| 3,269,056 | A * | 8/1966 | Hockman et al. | 446/158 |
| 3,277,602 | A * | 10/1966 | Speers et al. | 446/380 |
| 3,332,165 | A * | 7/1967 | Losonczy et al. | 446/158 |
| 3,464,154 | A * | 9/1969 | Di Leva | 446/158 |
| 3,601,922 | A * | 8/1971 | Shaffer | 446/158 |
| 3,693,292 | A * | 9/1972 | Di Leva | 446/158 |
| 4,135,326 | A * | 1/1979 | Tong | 446/158 |
| 4,500,297 | A * | 2/1985 | Boulva | 440/27 |
| 4,795,381 | A * | 1/1989 | Willems | 440/26 |
| 2004/0209545 | A1 * | 10/2004 | Rudell et al. | 446/454 |

* cited by examiner

*Primary Examiner*—Gene Kim
*Assistant Examiner*—Alyssa M Hylinski
(74) *Attorney, Agent, or Firm*—Lowe Hauptman Ham & Berner, LLP

(57) ABSTRACT

A swimming robot according to the present invention is constructed to simulate a human body having an upper portion including a chest 3, back 6, a swivable head 2, a shoulder portion 8, a pair of rotatable arms 14, 16 and a lower portion 4 including a pair of movable legs 34, 36 and a movable hip portion 7. A handle 5 is attached to the back 6 of the swimming robot 1. The swimming motion of the swimming robot 1 according to the present invention comprises drive mechanisms such as, a manual drive mechanism, a leg drive mechanism and a head-tilt mechanism.

7 Claims, 4 Drawing Sheets

SWIMMING ROBOT

FIELD OF THE INVENTION

This invention relates a swimming robot and more particularly to a swimming robot in the form of a human body that swims with an approximation of two different strokes.

BACKGROUND FOR THE INVENTION

Swimming figure toys that simulate the natural movements are known. For example, U.S. Pat. No. 3,332,165 discloses an aquatic toy wherein the swimming figure swims with an overhead arm motion of a swimmer simultaneously with a flutter kick motion of a swimmer. As disclosed the swimming toy has a rigid torso, arms independently rotatable joined to the torso and legs pivotally connected to the torso. Means to rotate the arms and to pivot the legs in a limited distance in the form of a flutter kick are also provided.

A more recent patent of Shaffer, U.S. Pat. No. 3,601,922 discloses a mechanical doll with arms and legs that simulate the crawl stroke and flutter kick used by a person swimming in the water. Each arm of the doll has articulated upper and lower portions and while the legs kick in opposite phase to the arms on alternate sides of the doll a reciprocal operating mechanism rotates the arms in opposite alternate directions in relation to the trunk of the doll. The mechanism also rotates the lower arm positions in opposite directions in relation to the upper arm positions. In addition, means inner-connect the upper and lower arm portions of each arm for conjoint rotation when the arm undergoes rotation in relation to the trunk of the doll.

A further development in aquatic toys is disclosed in a U.S. patent of Tong, U.S. Pat. No. 4,135,326. The Tong patent discloses a floating toy that simulates a human swimmer and a battery operated motor housed in a water-tight compartment and connected to the legs and/or arms of the body by a linkage. The linkage is such as to cause the legs and/or arms of the body to oscillate to and fro relative to the body in simulation of the kicking movement of the legs of a swimmer to propel the toy through the toy through the water.

Notwithstanding the above, it is presently believed that there may be a market for a swimming robot in accordance with the present invention. It is believed that there may be a market for swimming robots because they include a head that turns from side-to-side corresponding with movement of the arms as well as means for using an alternate stroke. In addition, the robots in accordance with the invention may be motor propelled or propelled manually by an individual riding on the robot. Further, it is presently contemplated that the robot will be considerably larger than the prior art dolls and actually support a small child on the robots back or in another embodiment of the invention a fully grown adult. In addition, the robots in accordance with the present invention have sufficient flotation cells that keep the robot from sinking and for supporting an individual. The aquatic robots are also of durable construction and of relatively light weight and made of water resistant material.

BRIEF SUMMARY OF THE INVENTION

In essence the present invention contemplates a swimming robot having the form of a human body and that swims with a stroke of approximating the Australian crawl or a butterfly stroke. The robot includes a buoyant body having an upper portion that includes chest, neck and shoulder portions, a head that swivels from one side to the other and a pair or rotatable arms attached to the shoulder portions with one of the arms extending in a first direction and the other extending in a second direction. The body of the robot includes a lower portion connected to the upper body portion and including a pair of moveable legs adapted to move with a scissor like motion i.e. similar to that used by swimmers in the crawl. Means including a battery powered electric motor and battery are provided for rotating the arms and the head from side-to-side correlated with the movement of the arms. In practice the swimming robot is placed in the water in a face down position and the electric motor is energized by an individual riding on the back of the robot. Means are also provided for repositioning one of the arms to imitate the butterfly stroke.

The invention will now be described in connection with the accompanying drawings wherein like reference numerals have been used to identify like parts.

DESCRIPTION OF THE PREFERRED EMBODIMENTS OF THE INVENTION

The invention will now be further described by way of example with reference to the accompanying drawings.

Figure 1:
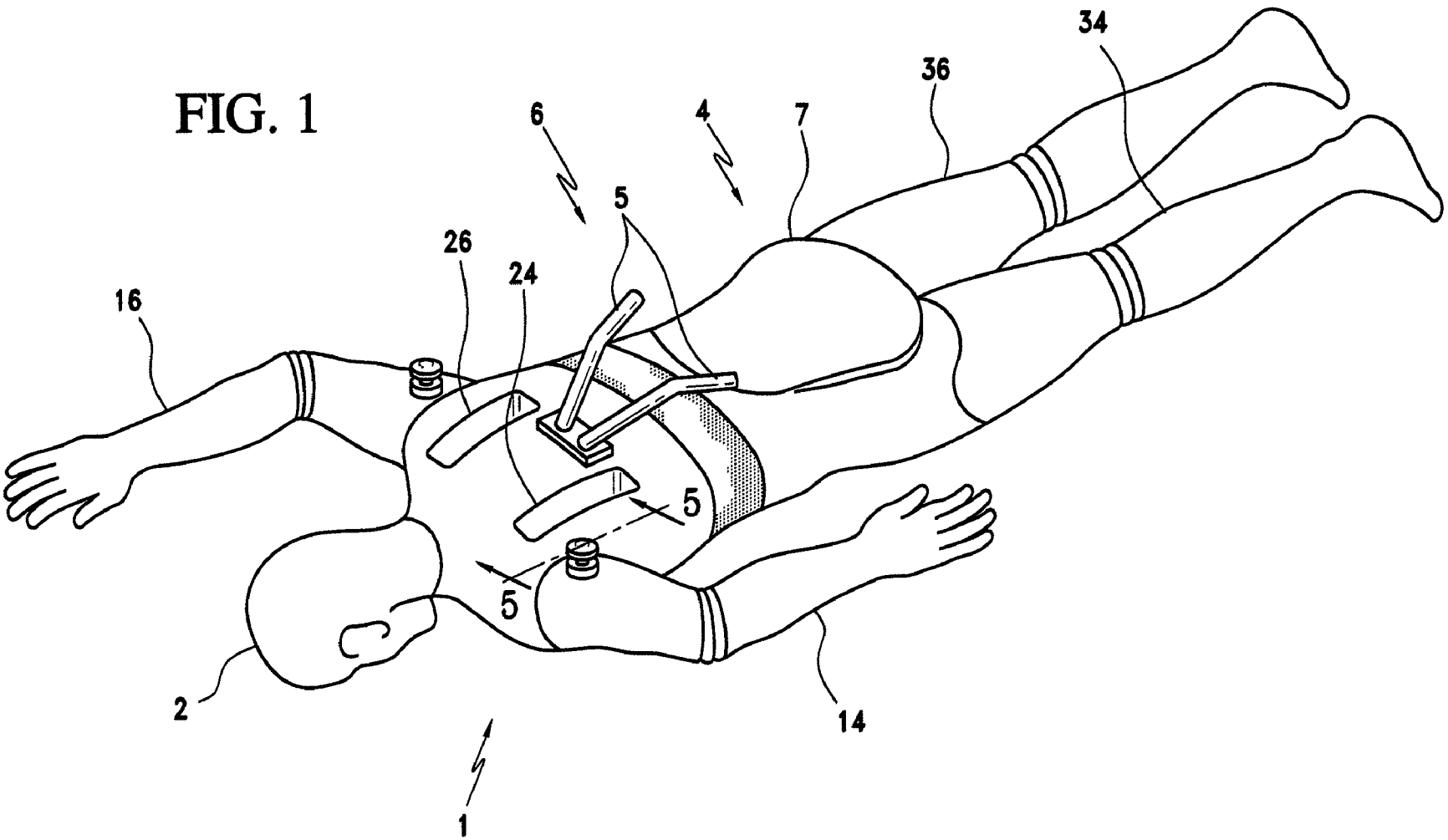
FIG. 1 is a perspective view partially broken away of a swimming robot in accordance with the present invention.

Referring to the drawings and initially to FIG. 1, it can be seen that a swimming robot according to the present invention is constructed to simulate a human body having an upper portion including a chest 3, back 6, a swivable head portion 2, a shoulder portion 8, a pair of rotatable arms 14, 16 and a lower portion 4 including a pair of movable legs 34, 36 and a movable hip portion 7. A handle 5 is attached to the back 6 of the swimming robot 1.

The swimming motion of the swimming robot 1 according to the present invention comprise drive mechanisms such as, a manual drive mechanism, a leg drive mechanism and a head-tilt mechanism, all of which will be described in the following paragraphs.

Figure 2:
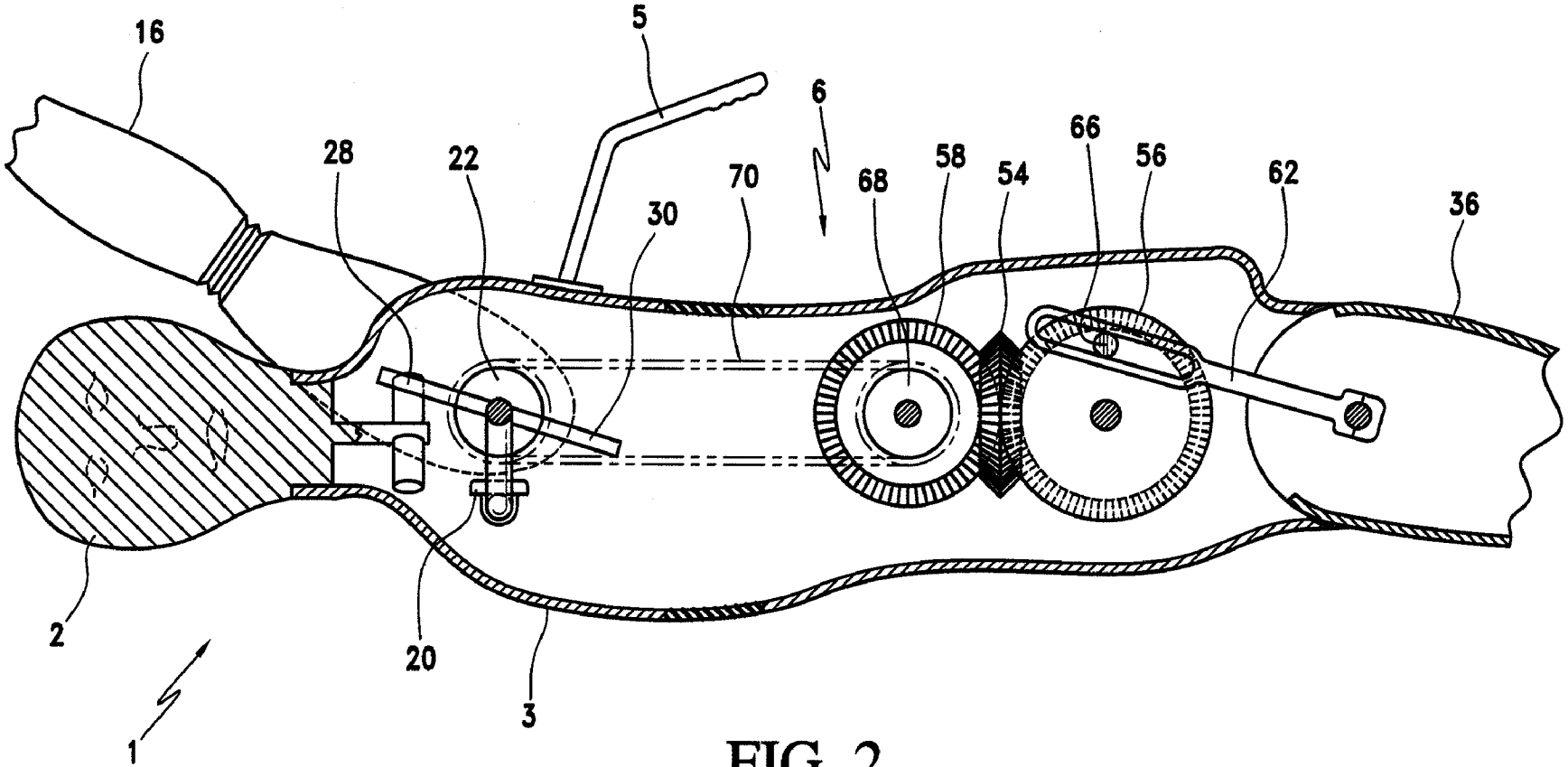
FIG. 2 is a side view partially broken away of the swimming robot shown in FIG. 1.

FIG. 2 shows a side view of the swimming robot 1 according to the present invention, specifically the manual drive mechanism, head-tilt mechanism and the leg drive mechanism. The manual drive mechanism includes a left arm 14 and a right arm 16 (FIG. 2), which are formed separate and are connected at their upper ends adjacent to the shoulder portion by a continuous horizontally disposed cross-shaft 12. The cross-shaft 12 supports the arms 14 and 16 for their complete rotational movement about the cross-shaft 12 as a pivot. The arms 14 and 16 are 180 degrees apart and rotate with the cross-shaft 12 in an alternate stroke. The cross-shaft 12 further comprises a left pedal 18 and a right pedal 20 located in the vicinity of the left arm 14 and the right arm 16 respectively. A pulley 22 can be mounted anywhere along the cross-shaft 12. A pair of leg or arm holes 24 and 26 corresponding to the left pedal 18 and right pedal 20 are provided on the back 6 of the swimming robot 1 as shown in FIG. 1. The leg holes 24 and 26 enable the person to operate the swimming robot 1 manually.

Figures 3, 5, 6:
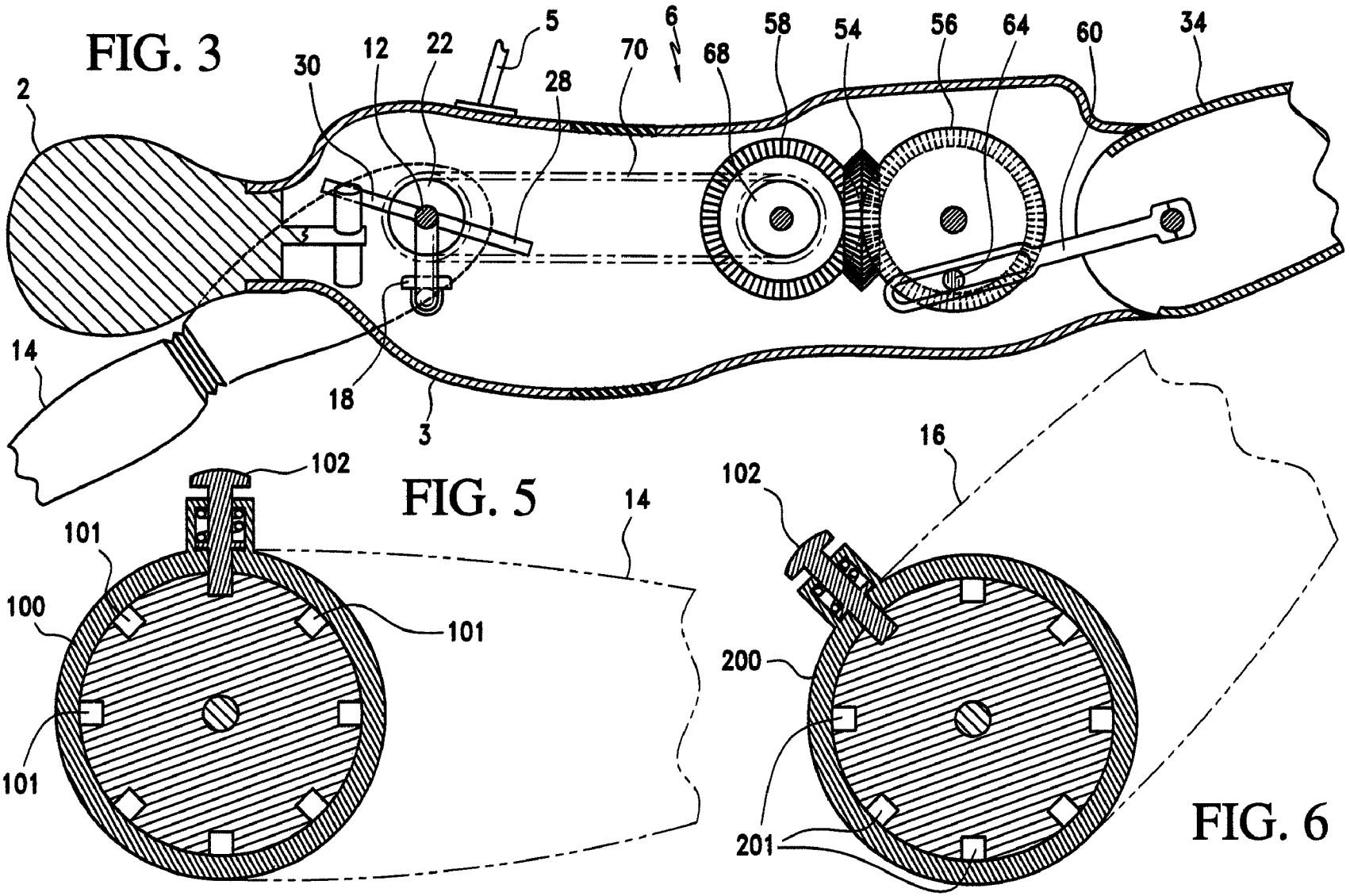
FIG. 3 is a side view of a swimming robot according to the present invention with its head tilted towards its right arm.
FIG. 5 shows a left arm disk for a swimming robot according to the present invention.
FIG. 6 shows a right arm disk for a swimming robot according to the present invention.
Figure 4:
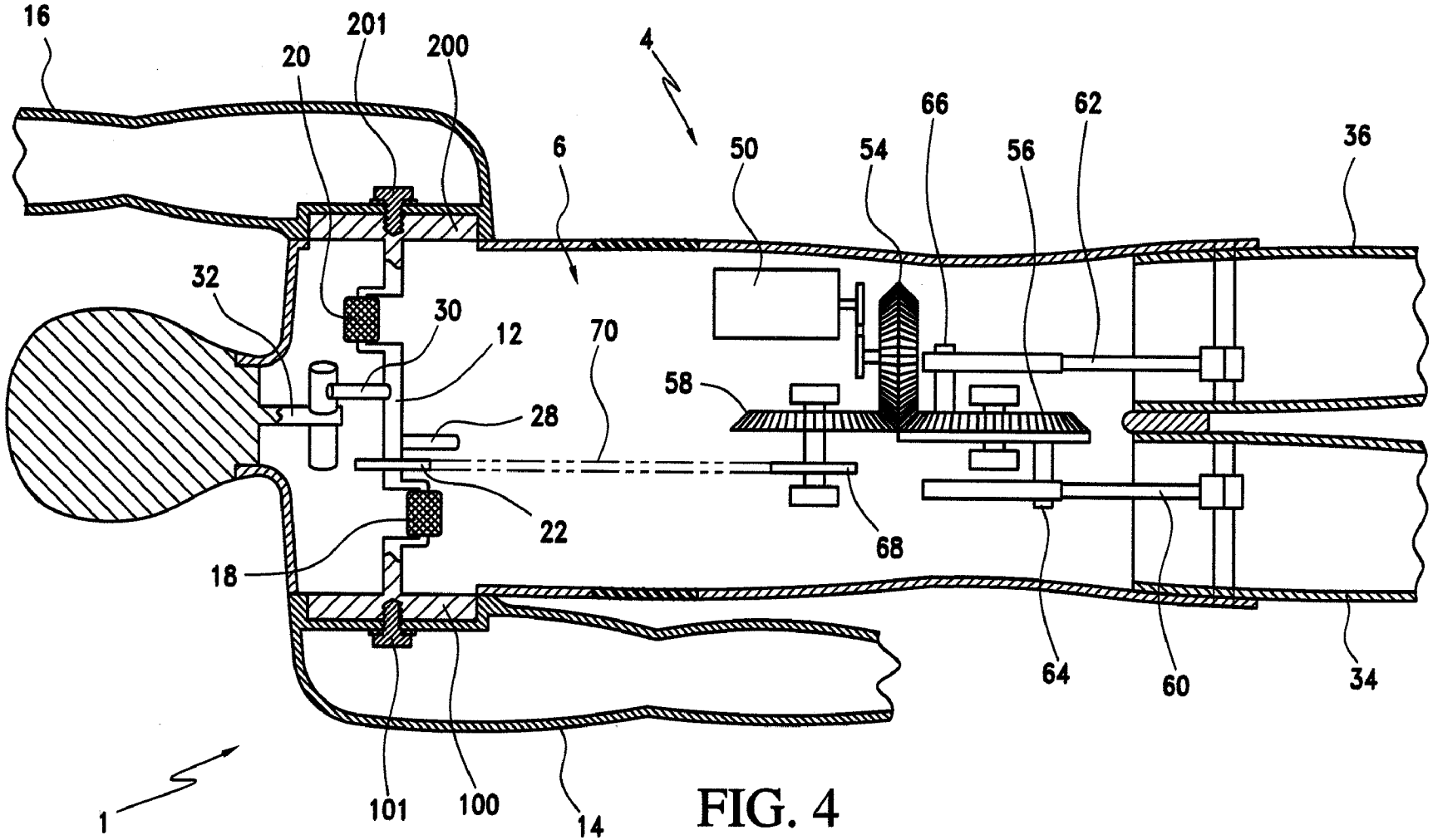
FIG. 4 is top view of the swimming robot according to the present invention showing the mechanism used to move the legs and the arms of a swimming robot.

A left-tilt bar 28 and a right-tilt bar 30 are located in proximity to the left pedal 18 and the right pedal 20 respectively. The swivable head 2 has a head-tilt bar 32 attached to a bottom of the head 2 as shown in FIGS. 2-4. The head-tilt bar 32, left-tilt bar 28 and the right-tilt bar 30 together form the head drive mechanism.

The leg drive mechanism includes a lower portion 4 having a battery operated motor 50 with a pulley 52 and the pulley thereby coupled to a plurality of gears 54, 56 and 58. The pulley 52 of the motor 50 is coupled to a first gear 54. The first gear 54 is further coupled to a second gear 56 and a third gear 58. The second gear 56 further has a pair of shafts 60 and 62. Each shaft 60 and 62 are connected at one end, to a left leg 34 and a right leg 36 respectively and another end of each of the shafts 60 and 62 are connected to the second gear 54 about their respective pins 64 and 66. The third gear 58 is coupled to the first gear 54 and has a pulley 68. The pulley 68 is connected to the pulley 22 on the cross-shaft 12 by a belt 70. Thereby the pulley 68, in operation, drives the cross-shaft 12.

FIG. 3 shows a swimming robot according to the present invention. The swimming robot 1 is in motion having its left arm 14 in a downward direction and the head 2 tilted towards the right arm 16 (FIG. 3).

Further, FIG. 5 shows an arm disk 100, for the left arm 14 of the swimming robot 1, having a plurality of openings 101 near the circumference of the arm disk 100. A bolt 102 connects the cross-shaft 12 and the left arm 14. The left arm 14 can be positioned, with respect to the position of right arm 16, by securing the bolt 102 to any of the openings 101 of the arm disk 100. FIG. 6 shows an arm disk 200, for the right arm 16 having a plurality of openings 201 near the circumference of the arm disk 200. A bolt 202 connects the cross-shaft 12 and the right arm 16. It is to be understood however that depending upon the stroke desired, such as breast stroke, forward stroke or backward stroke, either the left arm 14 or the right arm 16 can be positioned with respect to each other.

In operation, upon turning the motor 50 on, by a remote control (not shown), the pulley 52 drives the first gear 54. The first gear 54 drives the second gear 56 and the third gear 58. The movement of the second gear 56 causes the shafts 60 and 62 to rotate around their respective pins 64 and 66, and thereby moves the left leg 34 and the right leg 36 alternatively. The pulley 68 is set into motion by the third gear 58. The motion of the pulley 58 is transmitted to the pulley 22 on the cross-shaft 12 by a belt 70 thereby causing the cross-shaft 12 to rotate. The rotation of the cross-shaft 12 rotates the arm disks 100 and 200 thereby moving the left arm 14 and the right arm 16. Also, the rotation of the cross-shaft 12 rotates the left tilt-bar 28 and the right-tilt bar 30. The left-tilt bar 28 and the right tilt-bar 30 moves in correspondence to the rotation of the left arm 14 and the right arm 16 respectively and contacts the head-tilt bar 32, thereby tilting the head side ways with respect to the back 6. For example, during the forward stroke, the right arm 16 extends parallel to the head as shown in FIG. 4; upon further movement of the right arm 16 in the downward direction, the right-tilt bar 30 contacts the head-tilt bar 32 and pushes the head-tilt bar 32 thereby tilting the head 2 towards the left arm 1. The pair of leg or arm holes 24 and 26 corresponding to the left pedal 18 and right pedal 20 are provided on the back 6 of the swimming robot 4. The legs 34 and 36 can limited to move through an angle of about 20 degrees.

The robot 1 can also be operated manually. During the manual operation of the robot 1, a person rides on the back 6 of the robot 1 holding the handle 5 which is attached to the back 6. The leg or arm holes 24 and 26 corresponding to the left pedal 18 and right pedal 20 are provided for the person to position his legs on the left pedal 18 and the right pedal 20. Upon operating the pedal, the cross-shaft 12 rotates thereby rotating the pulley 22, the left-tilt bar 28, right-tilt bar 30, the left arm disk 100 with the left arm 14 and the right arm disk 200 with the right arm 16. The pulley 22 in turn rotates the pulley 68 in the lower portion 4 thus rotating the third gear 58 and the second gear 56 along with the shafts 60 and 62. The movement of the shafts 60 and 62 results in the movement of the legs 34 and 36 alternatively. Further, the hip portion 7 can swivel through a limited angle by using a mechanism similar to that of head-tilting mechanism as described above.

The swimming robot 1 according to the present invention may be of varied size and can be constructed of various materials such as rubber, plastic resins of various types, or other material. Interior of the robot 1 is hollow. The robot 1 must be of water tight construction in order to maintain buoyancy. By a proper selection weighting and buoyant members, the swimming figures is partially submerged when in water similar to the position in water of an actual swimmer.

It will be understood that the above description of a specific embodiment is by way of illustration only and is not to be construed as limiting the present invention to that embodiment.

What is claimed is:

1. A swimming robot in the form of a human body comprising a buoyant body having an upper portion including a chest, back and shoulder portion, a swivable head and a pair of rotatable arms attached to said shoulder portion with one of said arms extending in a first direction and the other of said arms extending in an opposite direction, and a lower swivel portion of said body having a bottom portion with an upper part of said lower portion of said body swivably connected to said upper portion of said body, a pair of moveable legs adapted to move with a scissor kicking motion attached to said bottom part of said lower portion of said body, and means including a battery powered electric motor and battery for rotating said arms, moving said head from side-to-side correlated with said rotating arms, moving said legs in a kicking motion in a coordinated swimming movement to propel the swimming robot through the water and a handle attached to said back of said body for holding by an individual person riding on back of said robot and a manual drive means, a cross shaft and a left peddle and a right peddle and a pair of leg holes for the person to position their legs on the left and right peddles to rotate said cross shaft and said arms and kick said legs to manually propel said robot through the water.

2. A swimming robot in the form of a human body in which each of said legs is limited to movement through an angle of about 20°.

3. A swimming robot in the form of a human body according to claim 2 which includes a waterproof container with said battery and said motor disposed in said container.

4. A swimming robot in the form of a human body according to claim 2 which includes a plurality of rotational components.

5. A swimming robot in the form of a human body according to claim 4 wherein said robot approximates the size of a human being with a length of about 48 inches.

6. A swimming robot in the form of a human body according to claim 5 in which said flotation compartments are filled with polystyrene foam.

7. A swimming robot in the form of a human body according to claim 6 which includes a pair of handles attached to said upper portion of said back of said body and said manual drive means includes a pulley in the lower portion and a gear for driving the movement of said legs.

* * * * *